US011214467B2

(12) United States Patent
Nielsen

(10) Patent No.: US 11,214,467 B2
(45) Date of Patent: Jan. 4, 2022

(54) LIFTING SYSTEM AND A CARRIER ELEMENT FOR SUCH A LIFTING SYSTEM

(71) Applicant: CRH CONCRETE A/S, Viby Sj. (DK)

(72) Inventor: Esben Nielsen, Aabenraa (DK)

(73) Assignee: CRH CONCRETE A/S, Viby SJ. (DK)

( * ) Notice: Subject to any disclaimer, the term of this patent is extended or adjusted under 35 U.S.C. 154(b) by 0 days.

(21) Appl. No.: 16/310,359

(22) PCT Filed: May 23, 2017

(86) PCT No.: PCT/EP2017/062402
§ 371 (c)(1),
(2) Date: Dec. 14, 2018

(87) PCT Pub. No.: WO2017/220276
PCT Pub. Date: Dec. 28, 2017

(65) Prior Publication Data

US 2019/0330029 A1 Oct. 31, 2019

(30) Foreign Application Priority Data

Jun. 22, 2016 (EP) ..... 16175732

(51) Int. Cl.
*B66C 1/16* (2006.01)
*B65D 19/38* (2006.01)
(Continued)

(52) U.S. Cl.
CPC ..... *B66C 1/16* (2013.01); *B65D 19/38* (2013.01); *B66C 1/22* (2013.01); *B66C 1/66* (2013.01); *B66C 23/62* (2013.01); *B66C 2700/00* (2013.01)

(58) Field of Classification Search
CPC .... B66C 1/16; B66C 1/22; B66C 1/28; B66C 1/66; B65D 19/38
(Continued)

(56) References Cited

U.S. PATENT DOCUMENTS 2,459,207 A * 1/1949 Worthington ..... B65D 19/0073 294/67.4
2,700,568 A * 1/1955 Meili ..... B66C 1/14 294/81.3
(Continued)

FOREIGN PATENT DOCUMENTS

FR 2058748 * 5/1971
JP 2009-269708 A 11/2009

OTHER PUBLICATIONS

International Search Report and Written Opinion received in PCT application No. PCT/EP2017/062402, dated Nov. 9, 2017, 11 pages.

*Primary Examiner* — Dean J Kramer
(74) *Attorney, Agent, or Firm* — Patent Portfolio Builders PLLC

(57) ABSTRACT

A lifting system for lifting a separate pallet with a heavy load is disclosed, the lifting system including two or more carrier elements and a suspension device in the form of a chain sling or a strap sling with double as many fastening ends as the number of carrier elements, wherein each of the carrier elements includes a stiff supporting beam and a distance element and is arranged so that two of the fastening ends of the suspension device can be fastened to the supporting beam in opposite ends thereof, and wherein the distance element is dimensioned and mounted onto the supporting beam in such a way that it prevents displacement of the carrier element relative to a pallet in the longitudinal direction thereof, when the carrier element is mounted transversely through the pallet. Furthermore, a carrier element for such a lifting system is disclosed.

11 Claims, 8 Drawing Sheets

Figure 1:
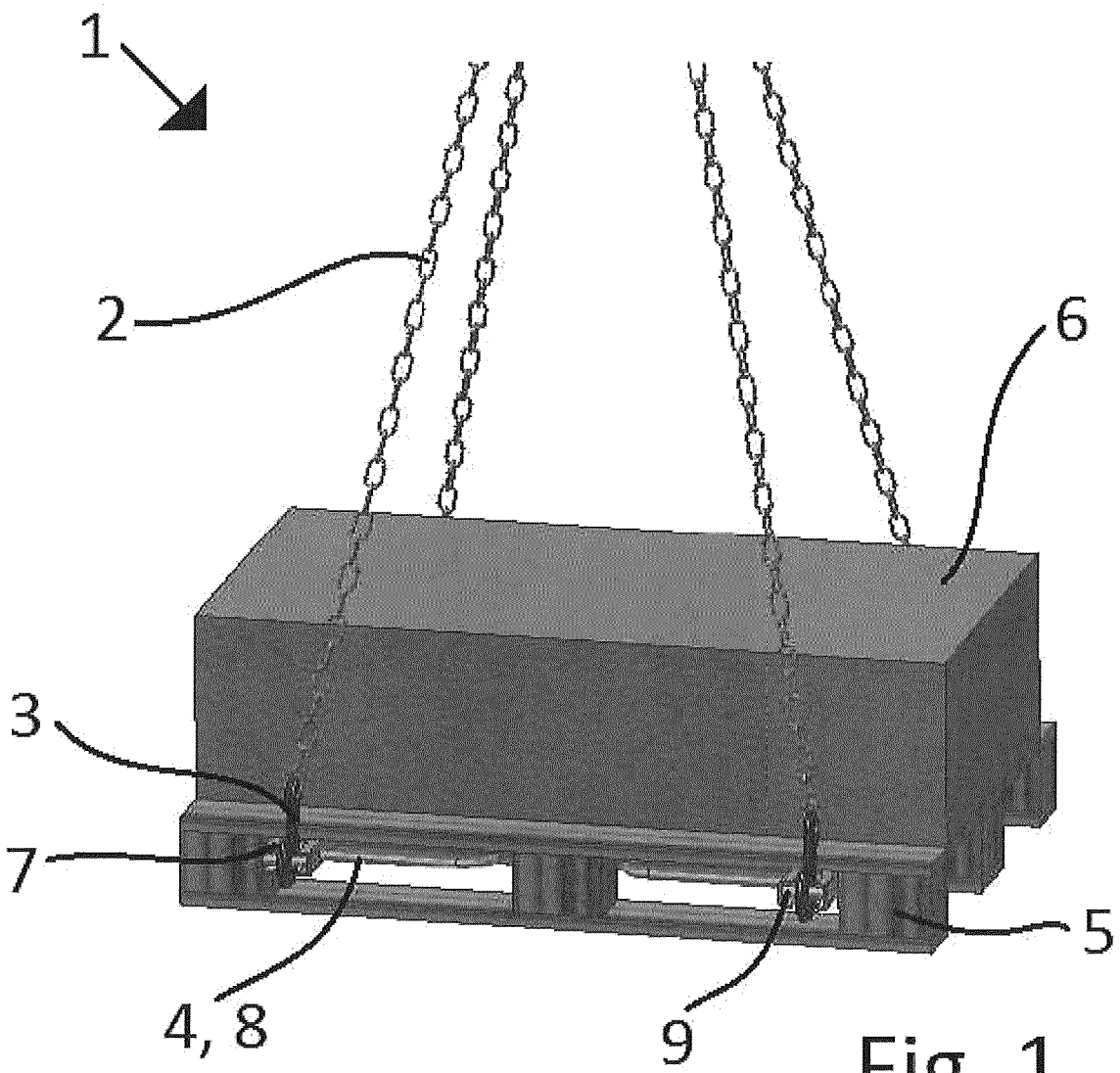

(51) Int. Cl.
*B66C 1/22* (2006.01)
*B66C 1/66* (2006.01)
*B66C 23/62* (2006.01)

(58) Field of Classification Search
USPC ..... 294/67.1, 67.3, 67.4
See application file for complete search history.

(56) References Cited

U.S. PATENT DOCUMENTS 2,721,756 A * 10/1955 Markussen ..... B66C 1/16
294/67.4
2,974,994 A * 3/1961 Goldsmith ..... B65D 19/38
294/67.1
3,065,987 A * 11/1962 Elsner ..... B65D 19/38
294/67.4
3,239,265 A 3/1966 Scibilia
3,493,128 A * 2/1970 Silvert ..... B65G 49/062
206/451
4,550,940 A 11/1985 Schweikert
4,736,975 A * 4/1988 Perez ..... B66C 1/16
294/74
5,340,180 A * 8/1994 Chase ..... B65D 19/44
108/55.5
6,565,136 B1 * 5/2003 Parker ..... B66C 1/16
294/67.2
7,810,861 B1 10/2010 Heinrichs

* cited by examiner

LIFTING SYSTEM AND A CARRIER ELEMENT FOR SUCH A LIFTING SYSTEM

CROSS REFERENCE TO RELATED APPLICATIONS

This application is a national phase filing under 35 U.S.C. § 371 of International Application No. PCT/EP2017/062402 filed May 23, 2017, which claims priority from EP application number 16175732.3, filed Jun. 22, 2016, the entire contents of which are hereby incorporated by reference herein.

The present invention relates to a lifting system for lifting a pallet with a heavy load, such as, for instance, tools and materials at construction sites where high security standards are required. Furthermore, the invention relates to a carrier member for such a lifting system.

BACKGROUND OF THE INVENTION

When heavy objects on pallets are to be lifted, it is a normal procedure to do so by means of slings, typically by mounting two slings transversely through the pallet under its "load layer", after which the pallet and what is on it, is lifted in these slings by means of a crane of one type or another. In most cases, this goes well.

Since the upward pull of the slings only affects the outermost board in either side of the pallet's load layer, however, there is a risk that the outer edge of both or perhaps just one of these outer boards can be flipped upwards when the pallet is lifted. This is, of course, primarily a problem when the pallet is heavily loaded, and the load does not fill the pallet surface completely.

In such cases, even very dangerous situation can occur because the position of the pallet relative to the slings and, thus, the balance point of the pallet may be dislocated which, in extreme cases, can lead to the entire pallet tilting in its suspension and parts of the load or even the entire load falling off the pallet. If a pallet frame is used to keep together the many small items on the pallet, it is also a risk that this pallet frame is lifted in one or both sides if the outer boards are tilted, whereby the items can fall out between the pallet frame and the pallet.

Another problem related to the known lifting techniques with the use of slings is that it is very important that the positioning of the slings relative to the pallet is adjusted before lifting it so that the slings are optimally positioned and a good balance is achieved, when the pallet is lifted. This means that it may be difficult or at least troublesome to handle such a lift, if there is only a single person available for this task.

BRIEF DESCRIPTION OF THE INVENTION

It is an object of the present invention to provide a lifting system, which eliminates the above-mentioned disadvantages related to the prior art within this technical field.

The present invention relates to a lifting system for lifting a pallet with a heavy load, said lifting system comprising two or more carrier elements and a suspension device in the form of a chain sling or a strap sling with double as many fastening ends as the number of carrier elements, wherein each of the carrier elements comprises a stiff supporting beam and a distance element and is arranged so that two of the fastening ends of the suspension device can be fastened to the supporting beam in opposite ends thereof, and wherein the distance element is dimensioned and mounted onto the supporting beam in such a way that it prevents displacement of the carrier element relative to a pallet in the longitudinal direction thereof, when the carrier element is mounted transversely through the pallet.

The invention is, inter alia, advantageous in that the stiffness of the supporting beams means that the load surface of the pallet is supported over its entire width, when the pallet is lifted by means of such a lifting system, whereby the risk that the outer edge of the outer boards can be flipped upwards is eliminated.

Furthermore, the distance element means that the carrier element can be positioned optimally relative to the pallet without adjustment, thereby making it much easier for a single person to handle a lift, than is the case with the prior art as described above.

In an embodiment of the invention, the supporting beams are provided with a lifting bolt in each of their ends, and each of the fastening ends of the suspension device is provided with a hook, which is designed to engage with such a lifting bolt.

The use of a hook engaging with a lifting bolt ensures a both simple and safe connection between the suspension device and the carrier element.

In an embodiment of the invention, the suspension device is dimensioned to be able to carry a load of at least 500 kg, preferably at least 1.000 kg, most preferably at least 2.000 kg.

In an embodiment of the invention, the lengths of the chains or straps are adjustable.

Such an adjustability enables for optimising the suspension device depending on the load to be lifted.

In an aspect of the invention, it relates to a carrier element for a lifting system according to any of the preceding claims, said carrier element comprising a stiff supporting beam and a distance element and being arranged so that two fastening ends of a suspension device in the form of a chain sling or a strap sling can be fastened to the supporting beam in opposite ends thereof, wherein the distance element is dimensioned and mounted onto the supporting beam in such a way that it prevents displacement of the carrier element relative to a pallet in the longitudinal direction thereof, when the carrier element is mounted transversely through the pallet.

In an embodiment of the invention, the distance element is designed as a distance bracket mounted onto the supporting beam.

In an embodiment of the invention, the supporting beam and/or the distance element are substantially made from a metal.

The use of metal ensures a robust carrier element, which is easily maintained without complicated maintenance checks of any art.

In an embodiment of the invention, the metal within the supporting beam and/or the distance element is hot-galvanized.

Hot galvanizing these elements significantly increases the expected lifetime of the carrier element.

In an embodiment of the invention, the dimensions of the distance element are adjusted to the distance between two neighbouring supporting blocks of a standard EUR pallet, so that the carrier element can just be placed transversely through such a pallet.

EUR pallets are the most used type of pallets. Therefore, it is advantageous to have one or more sets of carrier elements, which are adapted to be used with pallets of exactly this standard.

In an embodiment of the invention, the supporting beam is provided with a lifting bolt in each end for engagement with a hook of one of the fastening end of the suspension device.

In an embodiment of the invention, the underside of the supporting beam is bevelled at both ends of the supporting beam.

Beveling the underside of the supporting beam at its ends facilitates the mounting of the carrier element within the pallet.

THE DRAWINGS

Figure 2:
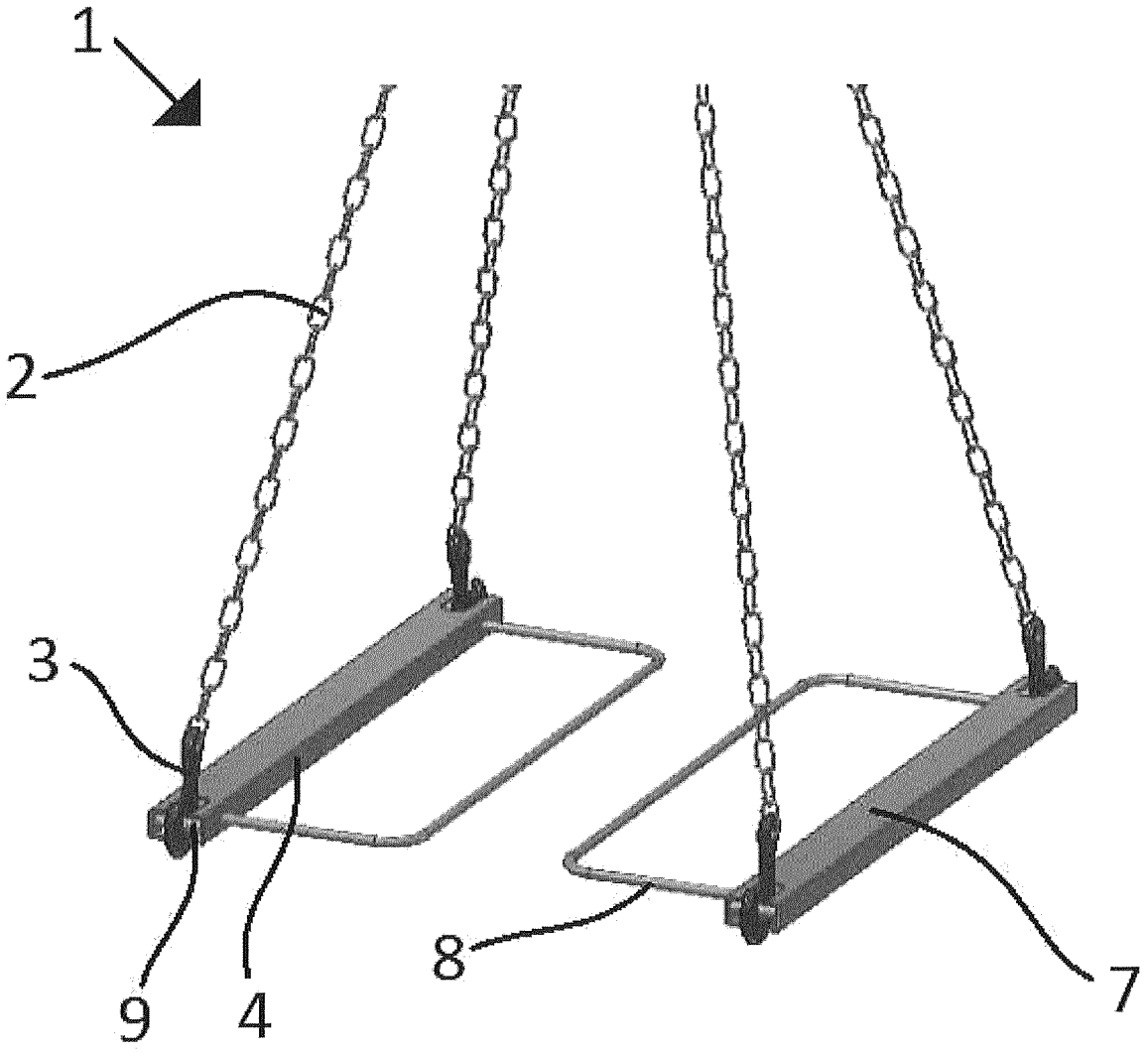
Figure 3:
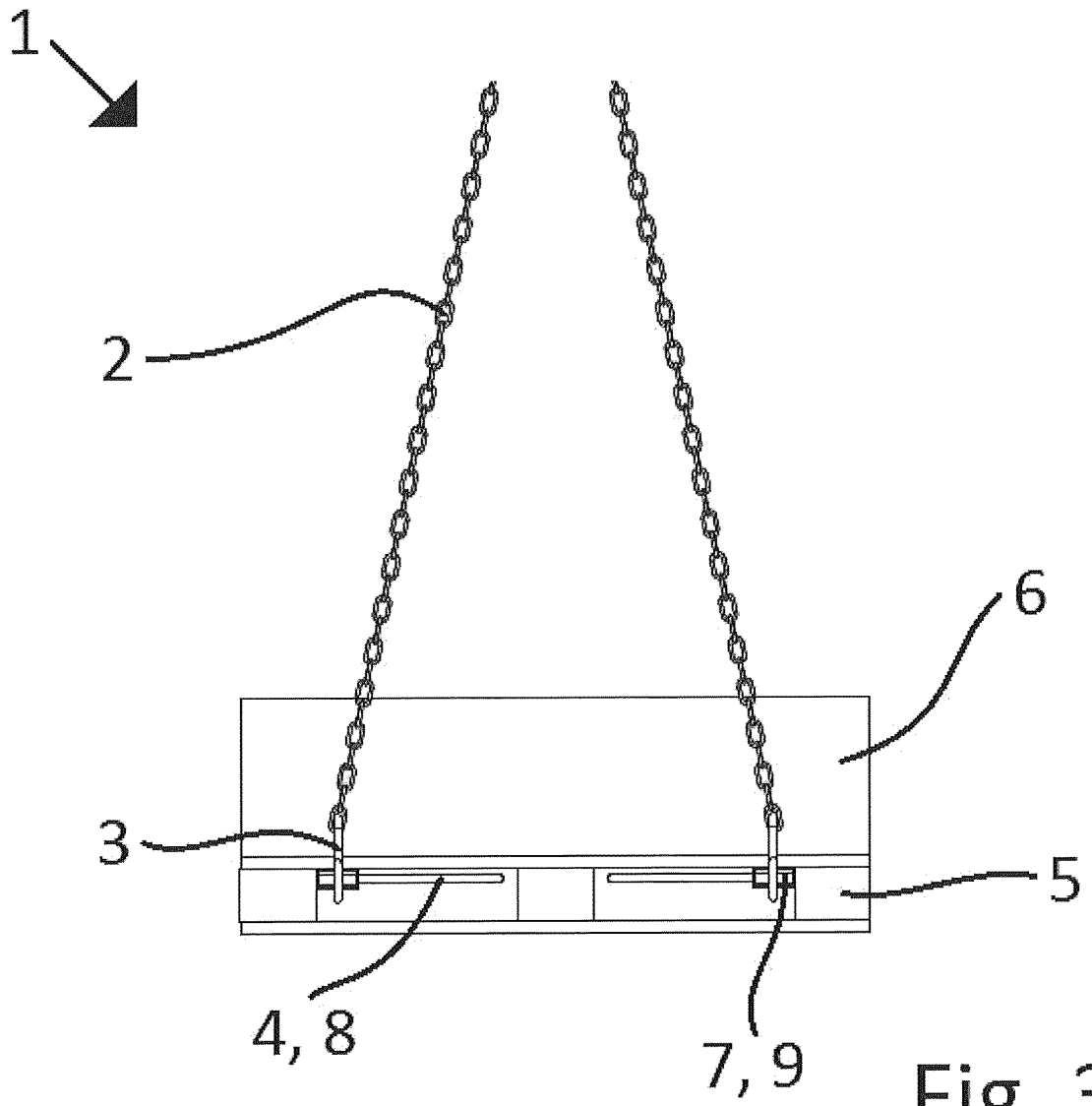
Figure 4:
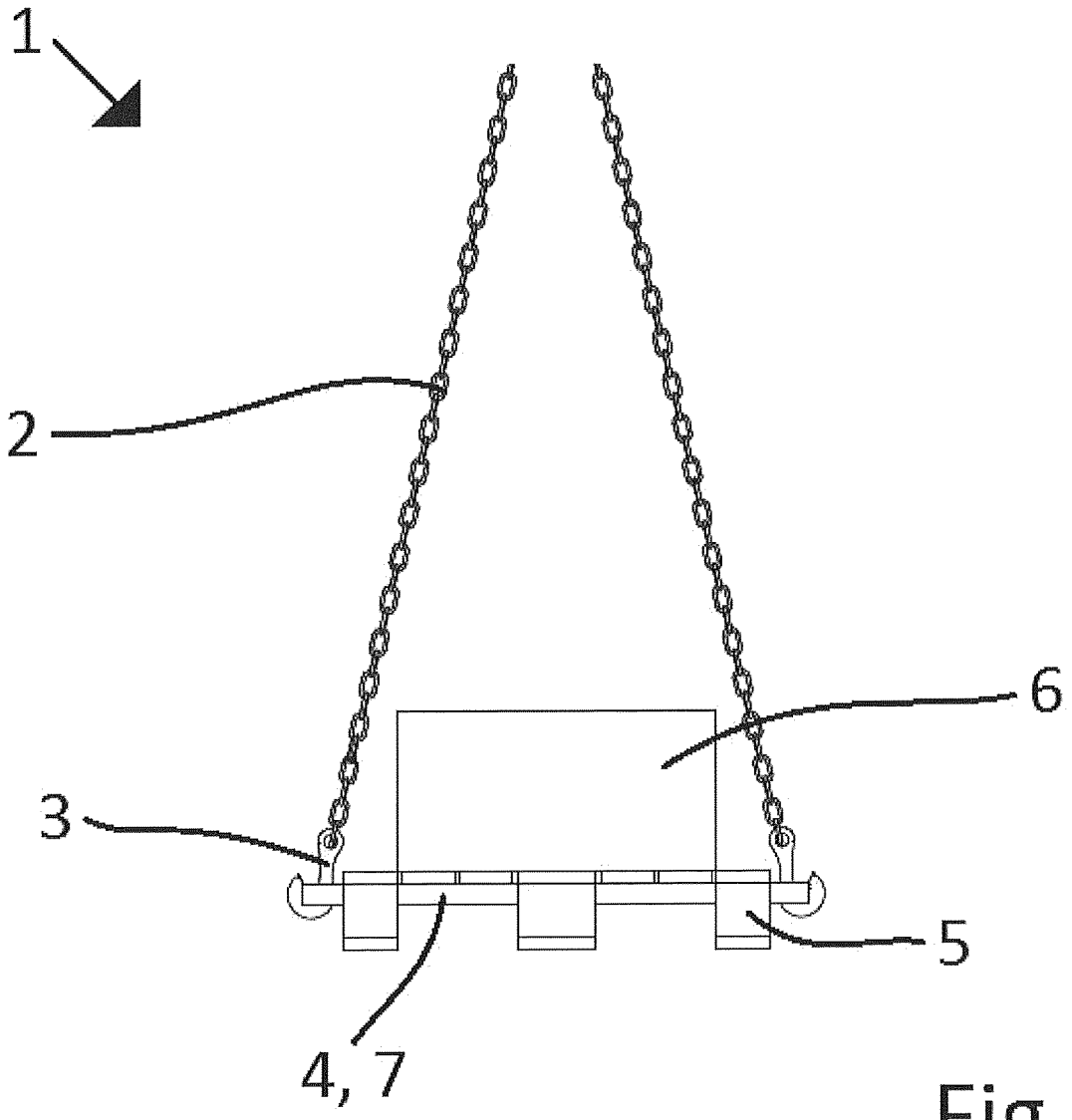
Figure 5:
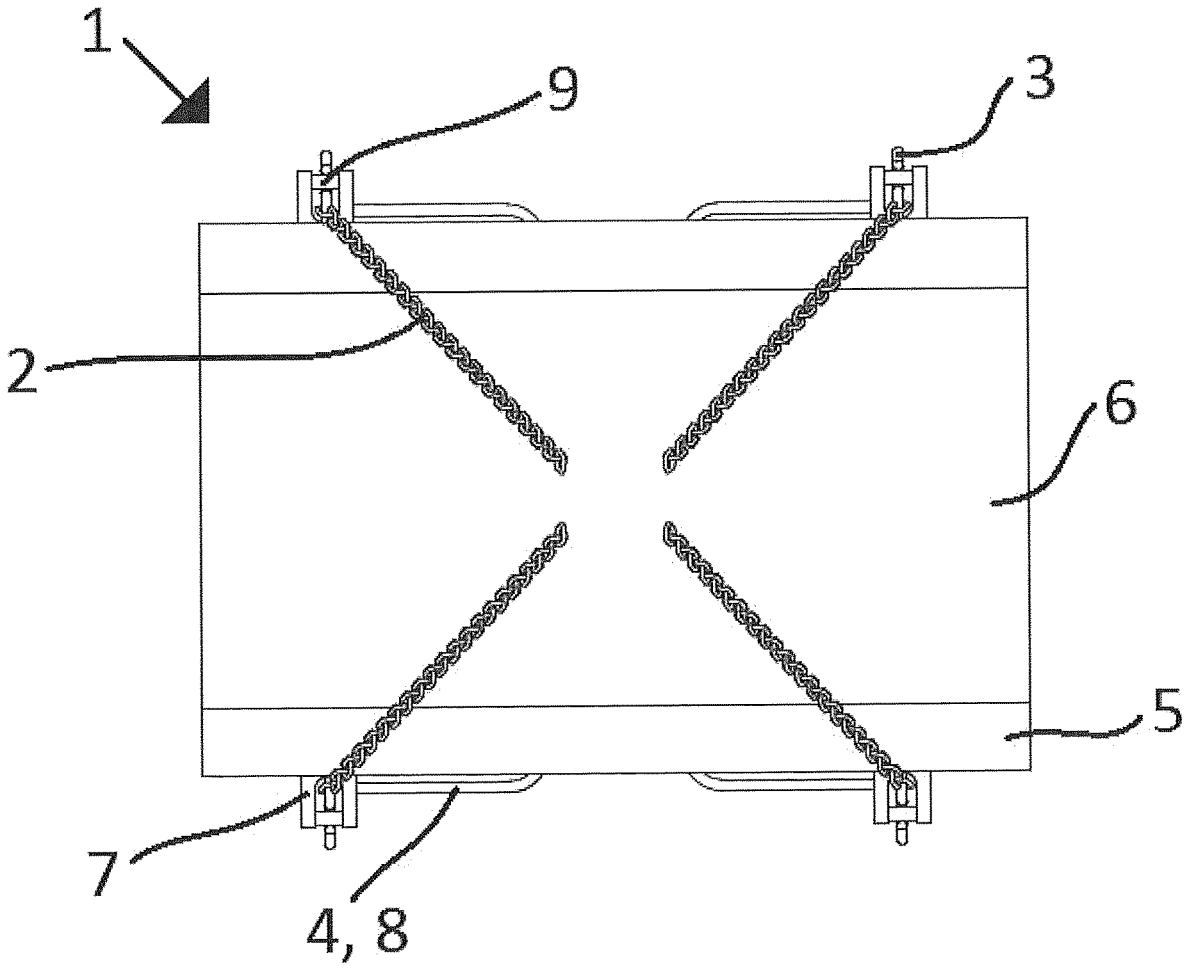
Figure 6:
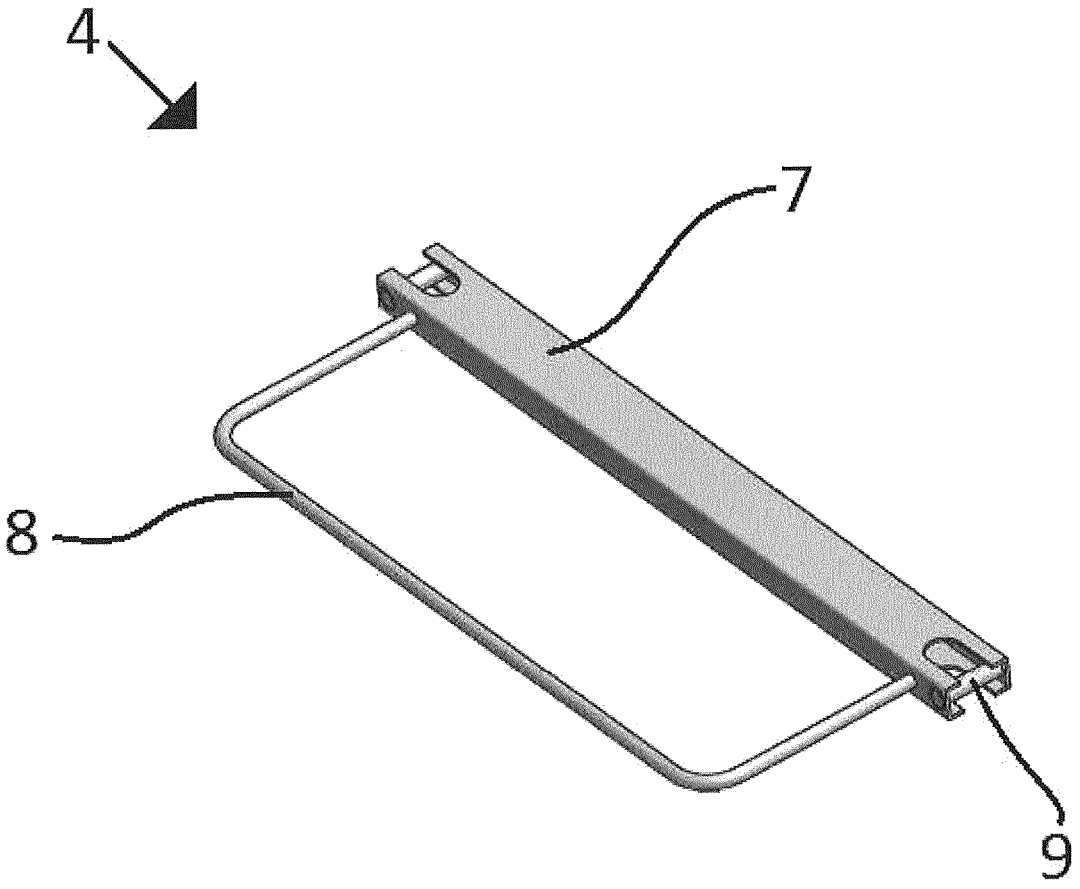
Figure 7:
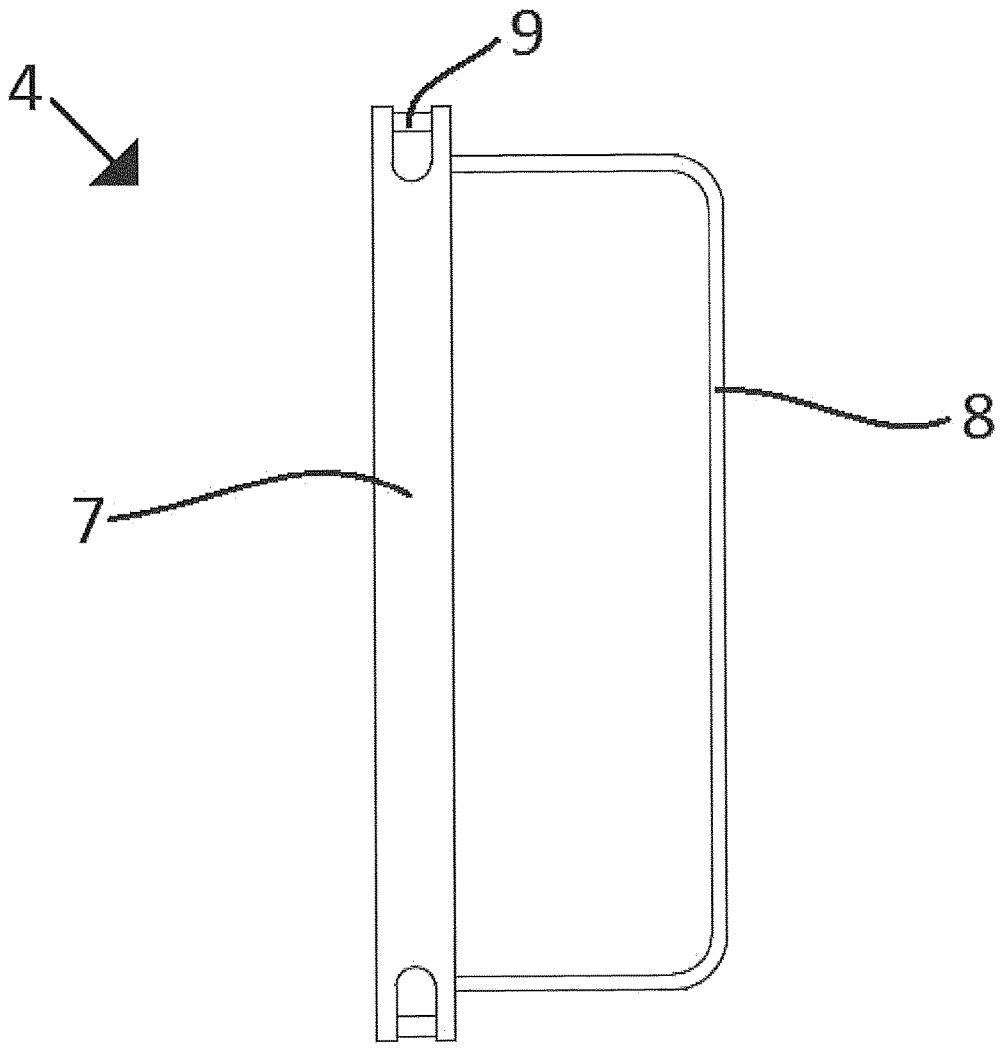
Figure 8:
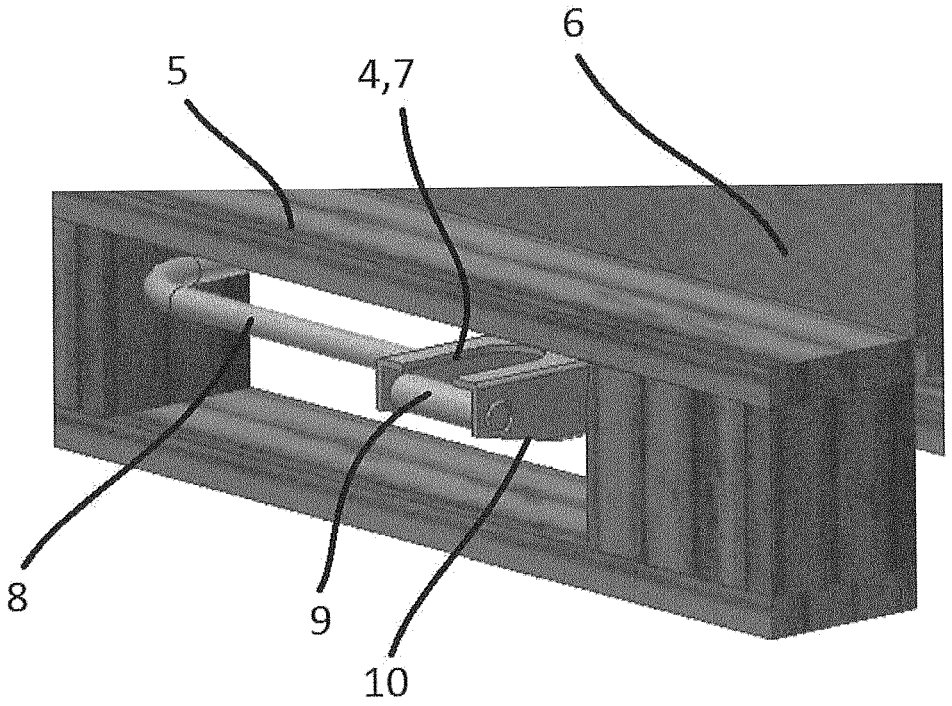

In the following, a few exemplary embodiments of the invention are described in more detail with reference to the drawings, of which FIG. 1 illustrates a lifting system according to an embodiment of the invention carrying a pallet with a load, FIG. 2 illustrates the same lifting system without the pallet and the load, FIG. 3 is a side view of the lifting system with pallet and load shown in FIG. 1, FIG. 4 is an end view of the lifting system with pallet and load shown in FIG. 1, FIG. 5 is a top view of the lifting system with pallet and load shown in FIG. 1, FIG. 6 illustrates a carrier element of a lifting system according to an embodiment of the invention, FIG. 7 is a top view of the same carrier element, and FIG. 8 illustrates partly a carrier element according to another embodiment of the invention being mounted within a pallet with a load.

DETAILED DESCRIPTION OF THE INVENTION

FIGS. 1 and 2 illustrate a lifting system 1 according to an embodiment of the invention, with and without a pallet 5 with a load 6, respectively.

In the illustrated embodiment, the suspension device 2 is constituted by a 4-part chain sling 2 with hooks 3 at the open ends of the chains. The two carrier elements 4 each consists of a distance bracket 8 and a supporting beam 7, at each end of which is mounted a transverse lifting bolt 9, with which the hooks 3 of the suspension device are in engagement.

As it can be seen, the lifting system 1 is used by mounting the carrier elements 4 transversely through the pallet 5 under the "load layer" thereof, after which the hooks 3 of the suspension device (2) are fastened to the ends of the supporting beams 7 of the carrier elements 4, and the pallet 5 with the load 6 can be lifted by means of a crane (not shown) having hold of the suspension device 2.

The distance brackets 8, which are arranged so that they are horizontal when the supporting elements 4 are mounted within the pallet 5, are dimensioned so that the carrier elements 4 can just pass between the supporting blocks of the pallet 5. This means that the carrier elements 4 cannot be displaced in the longitudinal direction of the pallet 5 and, therefore, do not need any adjustment to be optimally positioned, as long as they are correctly orientated.

FIGS. 3-5 illustrate the lifting system 1 with more details as seen from different angles, whereas FIGS. 6 and 7 show more details of the carrier element 4.

FIG. 8 illustrates partly a carrier element 4 according to another embodiment of the invention being mounted within a pallet 5 with a load 6.

In this embodiment, the underside of the supporting beam 7 is bevelled 10 at both ends of the supporting beam 7 for facilitating the mounting of the carrier element 4 within the pallet 5.

LIST OF REFERENCE NUMBERS

1. Lifting system
2. Chain sling
3. Hook
4. Carrier element
5. Pallet
6. Load
7. Supporting beam
8. Distance bracket
9. Lifting bolt
10. Bevelled underside of supporting beam

The invention claimed is:

1. A lifting system for lifting a pallet with a heavy load, the lifting system comprising:

at least two carrier elements each having a stiff supporting beam and a distance element to be arranged through an interior of the pallet between two neighboring supporting blocks and transversely to longitudinal upper and lower planks of the pallet, and a suspension device in the form of a chain sling or a strap sling having twice as many fastening ends as the number of carrier elements, wherein each of the carrier elements is arranged such that two of the fastening ends of the suspension device can be fastened to the supporting beam in opposite ends thereof, and wherein the distance element is dimensioned and mounted onto the supporting beam in such a way that it prevents displacement of the carrier element relative to the pallet in the longitudinal direction thereof when the carrier element is mounted transversely through the interior of the pallet and transversely to the upper supporting planks of the pallet wherein the pallet is of the type comprising longitudinal upper and lower planks, being connected via different pairs of neighboring supporting blocks and the supporting beam of each carrier element and its distance element, are being adapted both to be arranged through the interior of the pallet between the different pairs of neighboring supporting blocks and transversal to the upper and lower planks.

2. The lifting system according to claim 1, wherein the supporting beams are provided with a lifting bolt in each of their ends, and each of the fastening ends of the suspension device is provided with a hook, which is designed to engage with such a lifting bolt.

3. The lifting system according to claim 1, wherein the suspension device is dimensioned to carry a load of 500 kg to 2000 kg.

4. The lifting system according to claim 1, wherein the lengths of the chains or straps are adjustable.

5. A carrier element for a lifting system for lifting a pallet comprising:

a stiff supporting beam and a distance element and being configured to be arranged such that two fastening ends of a suspension device in the form of a chain sling or a strap sling can be fastened to the supporting beam in opposite ends thereof, the carrier element arranged through an interior of the pallet between two neighboring supporting blocks and transversely to longitudinal upper and lower planks of the pallet, and, wherein the distance element is dimensioned and mounted onto the supporting beam in such a way that it prevents displacement of the carrier element relative to a pallet, to be lifted, in the longitudinal direction thereof wherein the pallet is of the type comprising longitudinal upper and lower planks, being connected via different pairs of neighboring supporting blocks and the supporting beam of each carrier element and its distance element, are being adapted both to be arranged through the interior of the pallet between the different pairs of neighboring supporting blocks and transversal to the upper and lower planks.

6. The carrier element according to claim 5, wherein the distance element is designed as a distance bracket mounted onto the supporting beam.

7. The carrier element according to claim 5, wherein the supporting beam and/or the distance element are substantially made from a metal.

8. The carrier element according to claim 7, wherein the metal within the supporting beam and/or the distance element is hot-galvanized.

9. The carrier element according to claim 5, wherein the dimensions of the distance element are the distance between two neighboring supporting blocks of a standard EUR pallet, so that the carrier element can just be placed transversely through such a pallet.

10. The carrier element according to claim 5, wherein the supporting beam is provided with a lifting bolt in each end for engagement with a hook of one of the fastening ends of the suspension device.

11. The carrier element according to claim 5, wherein the underside of the supporting beam is beveled at both ends of the supporting beam.

* * * * *